United States Patent [19]

Ozagir et al.

[11] Patent Number: 4,861,084

[45] Date of Patent: Aug. 29, 1989

[54] DOOR LOCK WITH EXTRA RELEASE

[75] Inventors: Ozcan Ozagir, Bolton; Raymond Proffitt, Manchester, both of Great Britain

[73] Assignee: Celmac Limited, Manchester, England

[21] Appl. No.: 165,947

[22] Filed: Mar. 9, 1988

[30] Foreign Application Priority Data

Mar. 13, 1987 [GB] United Kingdom ..... 8705983

[51] Int. Cl.[4] ..... E05C 1/16

[52] U.S. Cl. ..... 292/359

[58] Field of Search ..... 292/142, 150, 152, 160, 292/359

[56] References Cited

U.S. PATENT DOCUMENTS

| | | | |
|---|---|---|---|
| 396,571 | 1/1889 | Iddings et al. | 292/359 |
| 991,018 | 5/1911 | Powers | 292/359 |
| 1,192,269 | 7/1916 | Borland | 292/359 X |
| 2,125,518 | 8/1938 | Oldham | 292/359 |
| 2,200,714 | 5/1940 | Falk | 292/359 |
| 2,295,435 | 9/1942 | Teich | 292/359 |
| 2,316,493 | 4/1943 | Swarens et al. | 292/359 |
| 2,370,645 | 3/1945 | Falk | 292/359 |
| 2,400,403 | 5/1946 | Falk | 292/359 |
| 2,605,124 | 7/1952 | Hillgren | 292/359 X |
| 4,422,312 | 12/1983 | Chermoni | 292/359 X |

FOREIGN PATENT DOCUMENTS

| | | | |
|---|---|---|---|
| 322195 | 12/1929 | United Kingdom . | |
| 364396 | 1/1932 | United Kingdom | 292/359 |

*Primary Examiner*—Richard E. Moore

*Attorney, Agent, or Firm*—Nixon & Vanderhye

[57] ABSTRACT

A door having a releasable door lock is disclosed for use in e.g. a bathroom. The locking mechanism comprises a plate having a slot which in use is moved to surround the square section spindle and prevent its rotation. The plate is moved by means of a rotatable pin which includes a toothed wheel such that rotation of the wheel moves the plate and locks it in position. The door is releasable from the outside of the room in an emergency.

17 Claims, 2 Drawing Sheets

DOOR LOCK WITH EXTRA RELEASE

FIELD OF THE INVENTION

The invention relates to a door lock having an extra release feature. Such a lock may be used on a bathroom door where the occupant wants privacy but which can be opened from the outside in the event of an emergency.

BACKGROUND

A number of mechanisms for locking door locks having conventional square-section spindles have been proposed in the past. U.S. Pat. No. 991,018 (Powers) and GB-364,396 (Freeman) disclose the use of a U-shaped locking plate which in use is slid over the spindle to stop its rotation and the release of the door. However, on both of these, the locking plate is only releasable from one side of the door. Other door lock mechanisms are disclosed in U.S. Pat. No. 2,125,518 (Oldham), U.S. Pat. No. 2,295,435 (Teich), U.S. Pat. No. 2,400,403 and GB No. 322,195 (Good).

DISCLOSURE OF THE INVENTION

According to one aspect there is provided a door for releasably closing a room, the door incorporating a locking device for locking the door from inside the room, the door also having means accessible from outside the room whereby the door may be opened in the event of an emergency, the door having a handle including a spindle which passes through the hole in the door and the means comprising a locking pin releasable from either side of the door, in which the door has a hole extending through the door thickness, a face plate being present about the hole on each side of the door, the face plate including at least one hole for receiving the handle spindle and another hole for receiving the locking pin, the spindle extending through its hole and having at each end a handle receiving portion in engagement with a handle, the pin extending through its hole generally parallel to the spindle, a locking plate extending in the plane of the door and movable by the locking pin, the locking plate having a slot shaped to receive a portion of the spindle whereby rotation of the locking pin moves the plate between one position in which it prevents rotation of the spindle and another position in which the spindle is free to rotate.

Preferably the slot in the locking plate is defined by a fork at one end of the locking plate dimensioned to grip the spindle to stop rotation thereof.

The locking plate preferably includes an enclosed slot having a wall portion including engaging parts, and the locking pin extends through the enclosed slot and includes cooperating engaging parts so that rotation of the pin causes movement of the plate.

The wall portion of the enclosed slot preferably has teeth, and a wheel having cogs is mounted on the pin for cooperation with the teeth.

In a preferred feature, a shoulder is present on the pin and extends through the enclosed slot of the locking plate to be received in a shoulder-receiving slot in the wheel.

In the preferred embodiment the pin is shaped into a head by which the pin may be rotated by hand from one side of the door and the other end of the pin includes a slot to receive the blade of a screwdriver or the like and is accessible from the other side of the door.

In another aspect there is provided a kit of parts comprising:

a pin dimensioned to extend through the door generally parallel to the spindle of the mortice set, the pin having at one end means by which it may be rotated by hand and having at the other end a slot for receiving the blade of a screwdriver, a locking plate having means at one end for locking the spindle against rotation when in engagement therewith and having towards the other end an enclosed slot the wall of which includes a row of teeth, a wheel mountable on the pin for rotation therewith and including cogs for cooperation with the teeth of the enclosed slot of the locking plate when the pin extends therethrough.

BRIEF DESCRIPTION OF THE DRAWINGS

Other objects and many of the attendant advantages of this invention will be readily appreciated as the same becomes better understood, by reference to the following detailed description when considered in connection with the accompanying drawings wherein.

DESCRIPTION OF THE INVENTION

Figure 1:
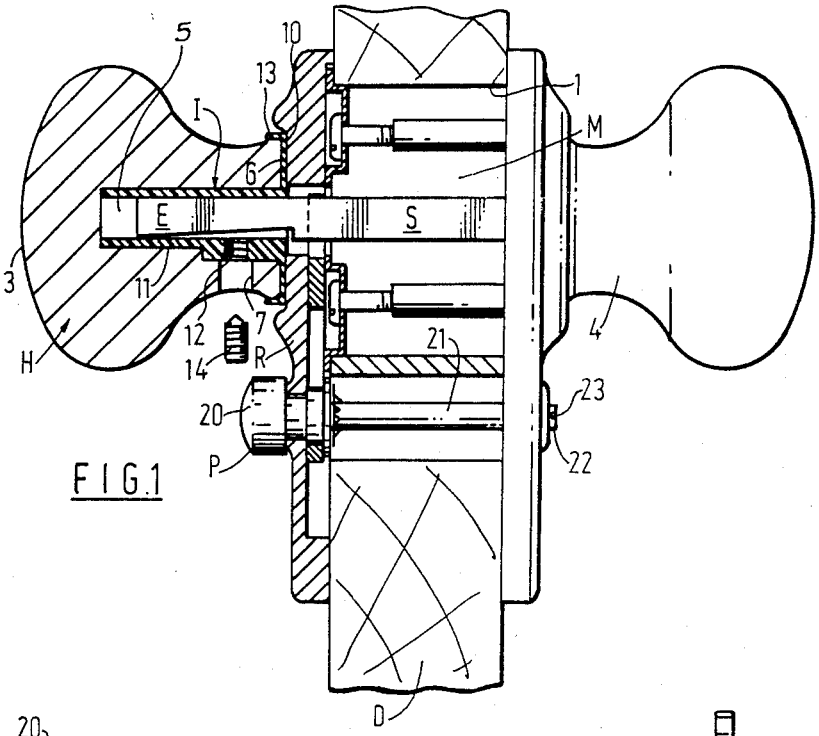
FIG. 1 is a sectional view through a door according to the invention.
Figure 2:
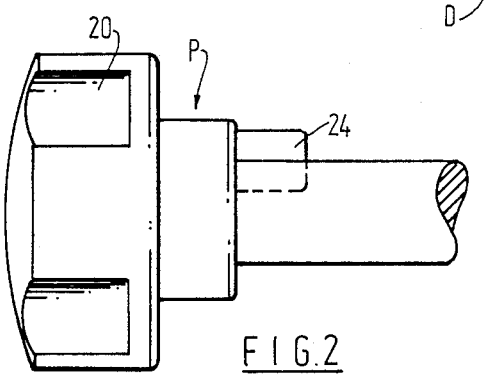
FIG. 2 is an enlarged view of one end of the pin.
Figure 3:
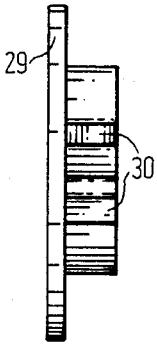
FIGS. 3 and 4 are side and elevation views of the wheel.
Figure 4:
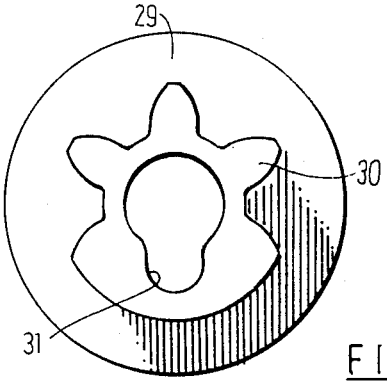
Figure 5:
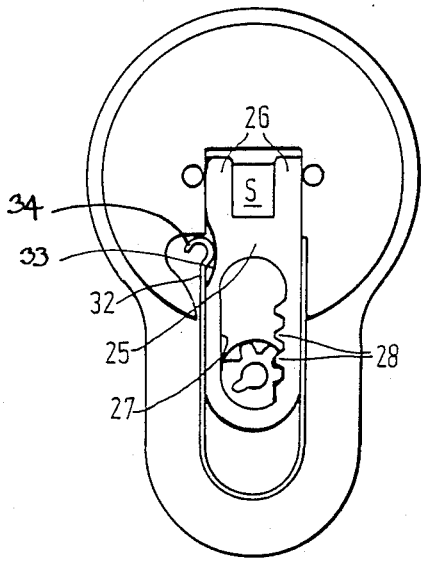
FIGS. 5 and 6 show in elevation the locking plate in the engaged and release conditions.
Figure 6:
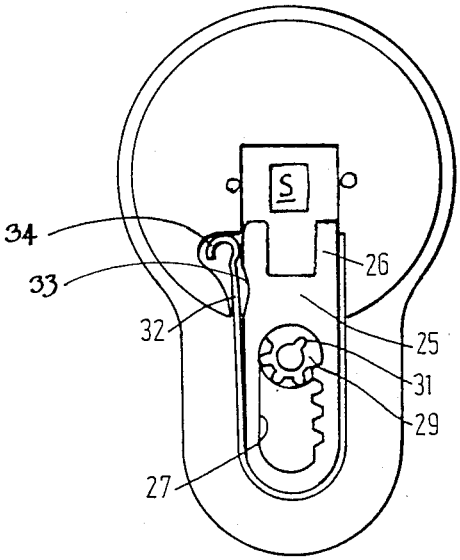

Referring now in greater detail to the various figures of the drawings, wherein like reference characters refer to like parts, there is shown generally in FIG. 1 a wooden door D having a through hole 1 which extends between opposite faces. A face plate R is secured to each face of the door about the hole 1. The face plate is formed of ceramic and has two holes, one for the handle H and the other for the release lock mechanism release pin P. A mortice M is present in the hole 1 and has a passageway to receive a metal spindle S. The spindle has handle receiving end portions E which project beyond the door faces and the end portions E taper towards the hole 1. The spindle S is square in cross-section, and in use operates a mortice lock (not shown) in known manner.

A handle H is cast in one piece of ceramic material and has a bulbous head portion 3 and a neck portion 4. A socket 5 extends from the flat end face 6 of the neck portion 4 into the head 3. The socket 5 has a shape complementary to that of the spindle but is slightly larger. A hole 7 for receiving a grub screw 14 extends from the side of the neck into the socket 5.

An insert I comprises a plastics moulding e.g. polyacetal and has a flat base 10 and shank portion 11. The insert I is received in the socket 5 of the handle H with the base 10 abutted against the neck face 6. The shank portion 11 has a hole 12 in axial alignment with that of the handle. The hole 12 is present in a stepped portion of the shank, and there is a corresponding depression in the handle. In such a way, the insert can only fit one way into the handle H. The base has a rim or lip 13 which surrounds the rim of the neck end face 6.

The release lock mechanism comprises a pin P having a head 20, an elongate shank 21 and an end 22 having a slot 23 therein to receive a screwdriver blade or coin. The shank 21 has an elongate shoulder 24 adjacent the head 20. A plate 25 has a forked upper end 26 and an enclosed slot 27 in its lower end. The wall of the slot 27 has spaced apart teeth 28. The pin shank 21 extends through the slot 27. A wheel 29 is mounted on the pin shank 21 on the remote side of the plate 25, and has teeth to cooperate with the teeth 28 of the plate 25. The wheel 29 includes a slot 31 to receive the shoulder 24 so that rotation of the pin causes the wheel 29 to rotate and translates the rotational movement into linear movement of the plate 25 up or down. The plate 25 is received in a slot in the inside face of the face plate R. The plate has a notch 33 formed into one edge. A leaf spring 32 is present to hold the plate 25 in position and includes a rounded portion 34, which in use is partially received in the notch 33, when the plate 25 is in the locked condition. The spring 32 prevents the plate 25 from moving off the spindle, except by rotation of the locking pin P.

In use, the spindle S is located in the door D. The insert I is urged into the socket 5 of the handle H and then pushed on to a spindle end portion E to cause the insert base 10 to abutt the face plate R. A screw 14 is then located in the aligned holes 7,12 to bear on the taper surface of the spindle end portion E. The same process is performed to locate the other handle H in position. Rotation of the handle H will rotate the spindle to release the door from its frame. Because of the base 10 there will not be abrasive rubbing of the handle against the plate R; because of the precise positive engagement of the screw 14 and the spindle end portion E there will be no play between the parts and the handle. It will not move off the spindle.

The occupant of the room closed by the door who requires privacy then rotates the pin head 20, so moving the locking plate 25 to lock the spindle 8 against rotation. He releases the lock by rotation in the reverse direction. In an emergency, a third party can open the door from the outside by rotating the pin P from the outside using a coin in the slot 23.

The handle and face plate may be formed from ceramic, glass, metal or the like.

What is claimed is:

1. For use in forming locking means accessible from both sides of a door of a given thickness and having a mortice set incorporating a spindle having a length greater than the door thickness, a kit of parts comprising:

a pin mountable to extend through the door generally parallel to the spindle of the mortice set, and having a length great enough to extend through the door, the pin having at one end means by which it may be rotated by hand and having at the other end a slot for receiving the blade of a screwdriver;

a locking plate having a recess at one end for receiving the spindle and preventing its rotation when receiving it, and having towards the other end an enclosed slot having a wall which includes a row of teeth; and a wheel mountable on the pin for rotation therewith and including cogs for cooperation with the teeth of the enclosed slot of the locking plate when the pin extends therethrough.

2. A door according to claim 1, wherein the slot in the locking plate is defined by a fork at one end of the locking plate dimensioned to grip the spindle to stop rotation thereof.

3. A door for releasably closing a room, and having spaced parallel major surfaces, and comprising:

a locking device for locking the door from inside the room, and including means accessible from outside the room so that the door may be opened in the event of an emergency;

means defining a hole in said door extending between said major faces thereof;

a spindle passing through said hole in the door;

said locking device comprising a locking pin engagable from either side of the door to rotate it to release it, and extending through said hole;

a face plate present about said hole on each side of the door, one of said face plates including a first hole for receiving said spindle, and a second hole for receiving said locking pin;

said spindle having at each end thereof a handle receiving portion in engagement with a handle;

said pin extending generally parallel to said spindle;

a locking plate extending in a plane substantially parallel to said door major faces, and having means defining a slot at one end thereof dimensioned to receive a portion of said spindle and stop rotation thereof when said locking plate is in a locking position;

said locking plate being mounted for movement between said locking position and a non-locking position in which said slot is spaced from said spindle and said locking plate does not hamper rotation thereof; and means defining cooperating gear teeth on said pin and said locking plate for cooperation so that rotation of said pin effects reciprocation of said locking plate between said locking and non-locking positions including—on said locking plate—an enclosed slot having a wall portion including said gear teeth, said locking pin extending through the enclosed slot and including gear teeth engaging the gear teeth of said slot wall portion.

4. A door according to claim 3, wherein the faceplate is formed of a ceramic material.

5. A door according to claim 3, wherein one end of the pin is shaped into a head by which the pin may be rotated by hand from one side of the door and the other end of the pin includes a slot to receive the blade of a screwdriver or the like and is accessible from the other side of the door.

6. A door according to claim 3, in which the handle is formed of material selected from the group consisting essentially of ceramic, glass, and metal.

7. A door as recited in claim 3 wherein said means defining engaging parts on said locking plate and said locking pin comprise means defining cooperating gear teeth on said pin and said plate for cooperation so that rotation of said pin effects reciprocation of said locking plate.

8. A door as recited in claim 7 wherein said means defining teeth on said locking pin define said teeth on a wheel mounted on said locking pin.

9. A door as recited in claim 7 further comprising means defining a recess in an exterior edge of said locking plate, and a spring having a rounded portion thereof biased into engagement with said recess, and providing a detent holding said locking plate in said locking position.

10. A door as recited in claim 7 wherein said means defining teeth associated with said locking plate comprises means defining a slot in said locking plate with a wall portion of said slot, said teeth formed in the said wall portion of said slot.

11. A door as recited in claim 3 further comprising a generally U-shaped spring element having a rounded portion biased into engagement with a side face of said locking plate, and guiding reciprocal movement of said locking plate.

12. A door as recited in claim 2 wherein said means defining engaging parts on said locking plate and said locking pin comprises means defining cooperating gear teeth on said pin and said plate for cooperation so that rotation of said pin effects reciprocation of said locking plate.

13. A door as recited in claim 12 wherein said means defining teeth on said locking pin define said teeth on a wheel mounted on said locking pin.

14. A door as recited in claim 3 further comprising means defining a recess in an exterior edge of said locking plate, and a spring having a rounded portion thereof biased into engagement with said recess, and providing a detent holding said locking plate in said locking position.

15. A door as recited in claim 12 wherein said means defining teeth associated with said locking plate comprises means defining a slot in said locking plate with a wall portion of said slot, said teeth formed in the said wall portion of said slot.

16. A kit of parts as recited in claim 1 further comprising a leaf spring with a rounded portion biased into engagement with an edge surface of said locking plate to frictionally retain the locking plate in a position to which it has been moved.

17. A kit as recited in claim 16 wherein said leaf spring is substantially U-shaped, and serves to guide movement of the locking plate.

* * * * *

UNITED STATES PATENT AND TRADEMARK OFFICE

CERTIFICATE OF CORRECTION

PATENT NO. : 4,861,084

DATED : August 29, 1989

INVENTOR(S) : OZAGIR et al

It is certified that error appears in the above-identified patent and that said Letters Patent is hereby corrected as shown below:

Column 3, line 61, in claim 2, change "door" to --kit of parts--

Signed and Sealed this

Eighth Day of January, 1991

*Attest:*

*Attesting Officer*

HARRY F. MANBECK, JR.

*Commissioner of Patents and Trademarks*